United States Patent [19]

Yoshino et al.

[11] Patent Number: 4,917,311

[45] Date of Patent: Apr. 17, 1990

[54] GARBAGE DISPOSER

[75] Inventors: Masataka Yoshino; Takao Morisaki; Hiromi Odogawa; Masaharu Oohori, all of Nakatsugawa, Japan

[73] Assignee: Mitsubishi Denki Kabushiki Kaisha, Gifu, Japan

[21] Appl. No.: 409,728

[22] Filed: Sep. 20, 1989

[30] Foreign Application Priority Data

| | | | |
|---|---|---|---|
| Sep. 27, 1988 | [JP] | Japan | 63-241383 |
| Oct. 14, 1988 | [JP] | Japan | 63-258756 |
| Oct. 14, 1988 | [JP] | Japan | 63-258758 |
| Oct. 14, 1988 | [JP] | Japan | 63-258759 |
| Oct. 18, 1988 | [JP] | Japan | 63-262254 |

[51] Int. Cl.[4] ..... B02C 18/40

[52] U.S. Cl. ..... 241/36; 241/46 A

[58] Field of Search ..... 241/46 A, 46 B, 46.11, 241/46.17, 100.5, 36

[56] References Cited

U.S. PATENT DOCUMENTS

| | | | |
|---|---|---|---|
| 2,294,179 | 8/1942 | Hawley | 241/46 A |
| 2,307,059 | 1/1943 | Moore | 241/46 A |
| 2,594,675 | 4/1952 | Camaunt, Sr. | 241/46 A |
| 4,034,422 | 7/1977 | Färber et al. | 241/46 A |
| 4,253,616 | 3/1981 | Timmer | 241/46 B |

FOREIGN PATENT DOCUMENTS

| | | |
|---|---|---|
| 55-5746 | 1/1980 | Japan . |
| 55-43549 | 3/1980 | Japan . |
| 55-88864 | 7/1980 | Japan . |
| 59-180741 | 12/1984 | Japan . |
| 62-23454 | 1/1987 | Japan . |
| 62-23455 | 1/1987 | Japan . |

*Primary Examiner*—Timothy V. Eley

[57] ABSTRACT

A garbage disposer includes a pulverizing unit, adapted to communicate with a basin of a sink through a drain hole of the basin, for pulverizing the garbage charged through the drain hole together with water, a straining unit, connected to the pulverizing unit through a transporting mechanism, the straining unit including a straining casing, a straining drum, supported within the straining casing for rotation about a horizontal axis, and a motor for rotating the straining drum, the straining drum having a circumferential face with a multiplicity of perforations formed therethrough for straining out the garbage pulverized in the pulverizing unit.

9 Claims, 6 Drawing Sheets

GARBAGE DISPOSER

BACKGROUND OF THE INVENTION

The present invention relates to a garbage or food waste disposer into which garbage, such as vegetable waste, is flushed through a sink drain to be pulverized.

The conventional garbage disposer has pulverizing blades rotatably mounted within a casing which is interposed between a drain of a sink and a drain pipe. The garbage disposer pulverizes garbage, which is flushed into it with the aid of water from the sink drain, to form a thick liquid mixture, which is discharged into the drain pipe. A typical example of the prior art garbage disposer is disclosed in Japanese Patent Application Kokai Publication No. 5746/1080.

To avoid pollution of the environment, the conventional garbage disposer should be used in an area where sewage treatment is provided to treat such pulverized garbage in a thick liquid state. The use of the garbage disposer is often prohibited in some districts so as not to produce a great amount of garbage.

SUMMARY OF THE INVENTION

Accordingly, it is an object of the present invention to provide a garbage disposer which enables pulverized garbage to be disposed in a system separate from a system of drains, thus removing restriction in use.

With this and other objects in view, the present invention provides a garbage disposer comprising: pulverizing means, adapted to communicate to a basin of a sink through a drain hole of the basin, for pulverizing the garbage, discharged through the drain hole together with water; straining means, connected to the pulverizing means, the straining means including a straining casing, a straining drum supported within the straining casing for rotation about a horizontal axis, and a motor for rotating the straining drum, the straining drum having a circumferential face with a multiplicity of perforations formed therethrough for straining out the garbage pulverized in the pulverizing means transporting means for transporting the garbage pulverized in the pulverizing means together with the water onto the circumferential face of the straining drum; and discharging means, connected to the straining means, for discharging the strained, pulverized garbage from the straining means.

BRIEF DESCRIPTION OF THE DRAWINGS

The invention will now be described by way of example with reference to the drawings in which.

DETAILED DESCRIPTION OF THE PREFERRED EMBODIMENTS

Figure 1:
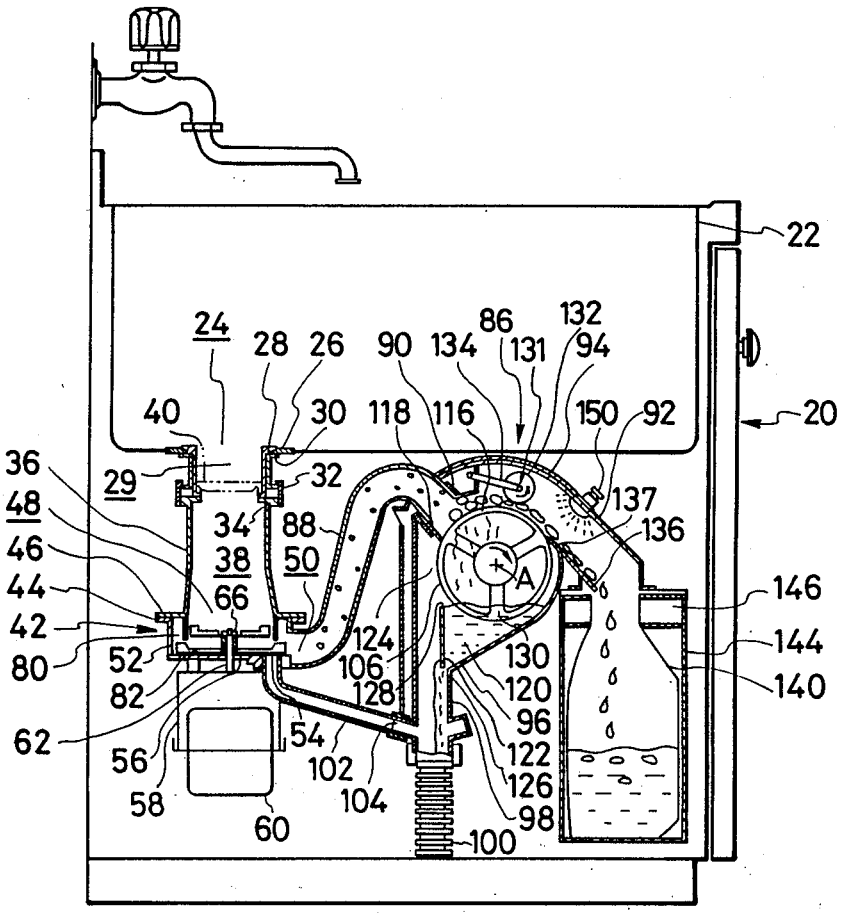
FIG. 1 is a vertical sectional view of a garbage disposer of an embodiment of the present invention, the disposer being mounted to a sink.
Figure 2:
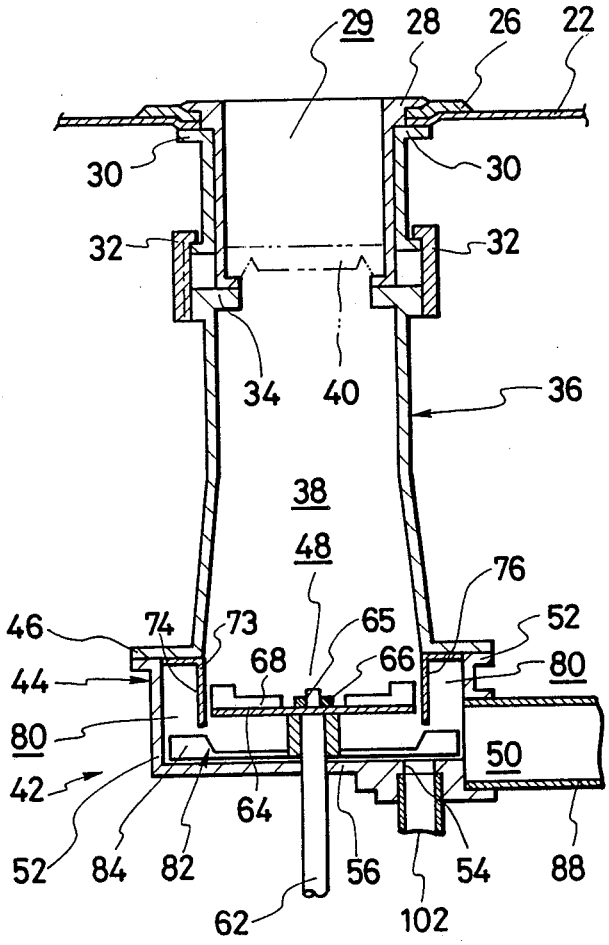
FIG. 2 is an enlarged vertical sectional view of the pulverizing unit in FIG. 1.
Figure 3:
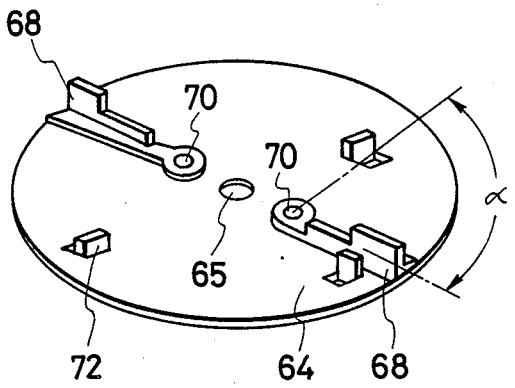
FIG. 3 is an enlarged perspective view of the pulverizing disk in FIG. 1.
Figure 4:
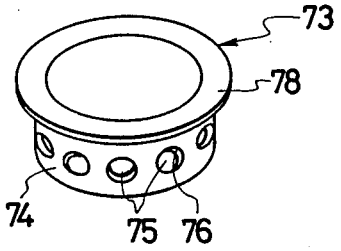
FIG. 4 is an enlarged perspective view of the stationary blade of FIG. 1.
Figure 5:
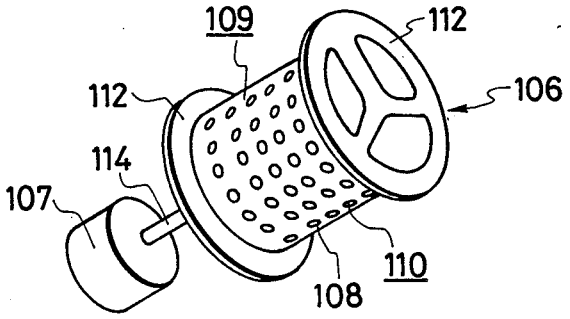
FIG. 5 is an enlarged perspective view of the straining drum of FIG. 1, the drum being coupled to a motor.

In the drawings, like reference numerals designate corresponding parts throughout several views and descriptions thereof are omitted after once given.

Referring to FIG. 1 to FIG. 5, reference numeral 20 indicates a sink which includes a basin 22 having a drain hole 24 in the bottom thereof. Fitted into the drain hole 24 is a drain flange 26. Inserted into the drain flange 28 is a drain basket supporting flange 28. A nut member 30 is threaded onto the drain basket supporting flange 28 for clamping both the inner periphery of the drain flange 26 and the peripheral wall of the drain hole 24 of the basin 22. The drain basket supporting flange 28 and the nut member 30 constitute a garbage charging port 29.

Another nut member 32 is attached to the nut member 30 so that it is rotatable about an axis of the nut member 30 and hence is vertically movable. The nut member 32 is threaded around an upper flange 34 of a generally hollow cylindrical casing 36 so that the upper flange 34 comes into abutment against the lower end flange of the drain basket supporting flange 28 for limiting and thereby securing the casing 36. The casing 36 defines a vertical garbage passage 38 which allows garbage from the garbage charging port 29 to pass therethrough.

A radially-slitted drain basket 40, made of a resilient material, is supported on the lower end flange of the drain basket supporting flange 28. The drain basket 40 has radial slits formed radially outwards from the center thereof at equal angular intervals for covering the garbage passage 38 and preventing pulverized garbage from splashing up from a pulverizing unit 42 which is connected to a lower end circumferential flange 46 of the casing 36.

The pulverizing unit 42 has a casing 44 concentrically mounted to the lower end circumferential flange 46 of the casing 36 to suspend from the latter. The casing 44 communicates with the garbage passage 38 at an inlet opening 48. The casing 44 has a pulverized garbage discharge opening 50, formed through a circumferential side wall 52 thereof, and a bypass drain hole 54 formed through the bottom wall 58 thereof. The bottom wall 56 of the casing 44 has a pulverizing motor mounting plate 58 attached to it. A pulverizing motor 60 is mounted to the mounting plate 58 so that a rotation shaft 62 thereof vertically passes through the bottom wall 56 of the casing 44 in a watertight manner and coaxially extends within the pulverizing unit 42. A pulverizing hammer mounting disk 64 is mounted coaxially at the tip of the rotation shaft 62 by a nut 66, the top end of the rotation shaft 62 passing through a center hole 65 of the pulverizing hammer mounting disk 64. The pulverizing hammer mounting disk 64 is provided with a pair of pulverizing hammers 68 and 68, each pivotably mounted by a pin 70 around the center hole 65 for pivotal movement parallel to the plane of the pulverizing hammer mounting disk 64. The pulverizing hammer mounting disk 64 has four vertical stopper plates 72 struck out therefrom so that the pivotal movement of the pulverizing hammers 68 is restricted by the stopper plates 72, and thus, the pulverizing hammers 68 swing about an angle of alpha, 90° in this embodiment, by rotating the pulverizing hammer mounting disk 64.

The reference numeral 73 indicates a stationary blade which includes a hollow cylindrical blade wall 74 having a multiplicity of throughholes 75 which are defined by circular cutting edges 76, the through holes 75 being formed at equal angular intervals about the axis of the cylindrical blade wall 74. The stationary blade 73 is coaxially attached at its circumferential flange 78 to the circumferential flange 46 of the casing 36 so that the blade wall 74 surrounds the pulverizing hammer mounting disk 64 with a gap of about 1 mm. The garbage is pulverized by shearing it between the pulverizing hammer 68 and the circular cutting edges 76.

An annular pulverized garbage chamber 80 is formed between the circumferential blade wall 74 and the circumferential side wall 52 of the casing 44. A plurality of vane members 82 are mounted to the rotation shaft 62 of the pulverizing motor 60 to extend radially outwardly within the casing 44 so that a vane 84, formed at the outer end of each vane member 82, is positioned just below the pulverized garbage chamber 80. The vanes 84 serve to expel pulverized garbage, received in the pulverized garbage chamber 80, out of the casing 44 through the pulverized garbage discharge opening 50.

The pulverizing unit 42 is connected to a generally hollow cylindrical wringing casing 86, through an S-shaped connecting pipe 88, one end of which communicates to the pulverized garbage discharge opening 50 of the casing 44 and the other end of which communicates to an inlet port 90 of the wringing casing 86. The wringing casing 86 is supported with respect to the sink 20 with its axis A horizontal. A pulverized garbage discharge pipe 92 communicates at one end thereof to the upper portion 94 of the wringing casing 86. The pulverized garbage discharge pipe 92 extends to the straining drum 106. The wringing casing 86 is further provided at its lower portion 96 with a vertical water discharge pipe 98 connected to a drain tube 100 for draining water from the wringing casing 86 to the drain tube 100.

The discharge pipe 98 communicates with the casing 44 through a bypass drain pipe 102 which is connected at its one end to a bypass port 104 of the drain pipe 98 and at its other end to a bypass port 54 of the pulverizing casing 44. While the pulverizing motor 60 is not rotating, water in the casing 44 is drained to the drain tube 100 through the bypass drain pipe 102. When the pulverizing motor 60 is rotating, water does not flow into the bypass drain pipe 102 due to pressure caused by the vane members 82. Furthermore, the gap between the bottom wall 56 of the casing 44 and the vane members 82 is arranged to be smaller than the size of the pulverized garbage. Thus, the pulverized garbage is prevented from entering the bypass drain pipe 102.

A straining drum 106 is coaxially mounted within the ringing casing 86 with the axis A above the casing 44 of the pulverizing unit 42 and is normally rotated in the direction of the arrow in FIG. 1 by a wringing motor 107 (FIG. 5) mounted to the sink 20. The straining drum 106 includes a hollow cylindrical drum body 108, the drum body having a circumferential face 109 with a multiplicity of straining perforations 110 formed therethrough. The drum body 108 is provided at its opposite edge with a pair of circular flanges 112 formed for preventing pulverized garbage from dropping from the edges. The straining drum 106 is coaxially mounted to a rotation shaft 114 of the wringing motor 107. For guiding a mixture of both the pulverized garbage and water to a top portion 116 of the drum body 108, a guide plate 118 is provided close to the inlet port 90 of the wringing casing 86 to extend toward the drum body 108.

A sump 120 is formed at the lower portion 96 of the wringing casing 86 by vertically mounting a damming plate 122 to opposite side walls 124 (only one of which is illustrated) of the annular pulverized garbage chamber 80 so that a water discharge opening 126 is formed at the bottom of the sump 120. A lower part 130 of the straining drum 106 is positioned within the sump 120. A portion of the water flows out of the sump 120 through the water discharge opening 126 and water overflowing the sump 120 flows down the damming plate 122. The level of the upper edge 128 of the damming plate 122 and the size of the water discharge opening 126 are so that a lower part 130 of the straining drum 106 is washed with water in the sump 120 for a predetermined flow rate of water.

Within the upper portion 94 of the wringing casing 86 there is provided a ringing roller unit 131 including a wringing roller 132 rotatably attached to free ends of a pair of swing arms 134 (only one of which is shown). The proximal end of each swing arm 134 is pivotably attached to the upper portion 94 of wringing casing 86. The wringing roller 132 is thus pressed against the circumferential face 109 of the drum body 108 of the straining drum 106 by gravity. When the straining drum 106 is rotated, the wringing roller 132 is rotated by friction in the direction indicated by the arrow in FIG. 1 and squeezes water out of the pulverized garbage which has been strained on the straining drum 106 upstream of the wringing roller 132.

A guide plate 136 is provided at the lower end of the pulverized garbage discharge pipe 92 to discharge the wrung garbage to a garbage bag 140 received within a garbage container 144. An opening portion of the garbage bag 140 is set in a conventional sealing unit 146. A cleaning nozzle 150 is provided to the upper portion 94 of the wringing casing 86 for cleaning the straining drum 106, the wringing roller 132 and the guide plate 136 with water to remove pulverized garbage adhered thereto after the disposal of the garbage.

Figure 6:
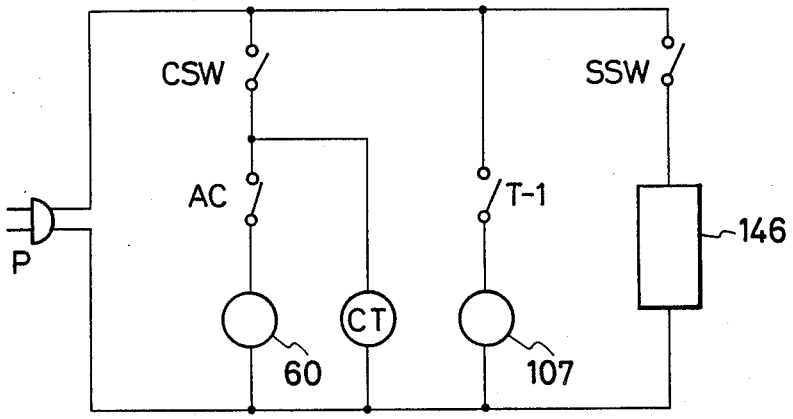
FIG. 6 is a diagram of an electric circuit which controls the garbage disposer in FIG. 1.

An electric circuit for controlling the pulverizing motor 60, the wringing motor 107 and the sealing unit 146 is illustrated in FIG. 6. In FIG. 6, P denotes a plug connected to a power source (not shown), and AC denotes an automatic circuit breaker.

In operation, when a manual switch CSW is closed, the pulverizing motor 60 is promptly started, and an off-delay timer CT is activated, so that a contact T-1 of the timer CT is closed and the wringing motor 107 is therefore started. Then, food waste is flushed with water through the garbage discharging port 29 into the pulverizing unit 42, in which the food waste is pulverized by means of both the pulverizing hammers 68 and the circular cutting edges 76 of the stationary blade 73 to form a mixture of pulverized food waste and water. The resulting material is fed by the vane members 82 through the connecting pipe 88 onto the straining drum 106, where part of the water is removed from the pulverized garbage through straining perforations 110 to the sump 120. The pulverized garbage is then transported to be wrung by the wringing roller unit 131, which further removes water by means of the wringing roller 132. The pulverized garbage thus squeezed is discharged to the garbage bag 140 through the pulverized garbage discharge pipe 92.

As the vane members 82 feed air into the garbage bag 140 through the connecting pipe 88 and then through the wringing casing 86, the garbage bag 140 is inflated. The inflation of the garbage bag 140 causes the wrung, pulverized garbage to drop into the garbage bag 140 without adhering to the portion near the opening of the garbage bag 140, and hence the portion near the opening is kept clean.

During rotation of the straining drum 106, garbage which adheres to it is washed with water in the sump 120.

When the switch CSW is opened, the pulverizing motor 60 is promptly stopped, while the off-delay contact of the timer CT is kept closed for a predetermined delay time, to thereby keep the wringing motor 107 running for a predetermined time interval. This enables all of the pulverized garbage on the straining drum 106 to reach and enter the garbage bag 140.

When a seal switch SSW is later closed, a sealing unit 146 is actuated. The sealing unit 146 automatically seals the opening portion of the garbage bag 140. Thereafter, the sealed garbage bag 140 which contains the wrung, pulverized garbage may be taken out from the garbage container 144.

Figure 7:
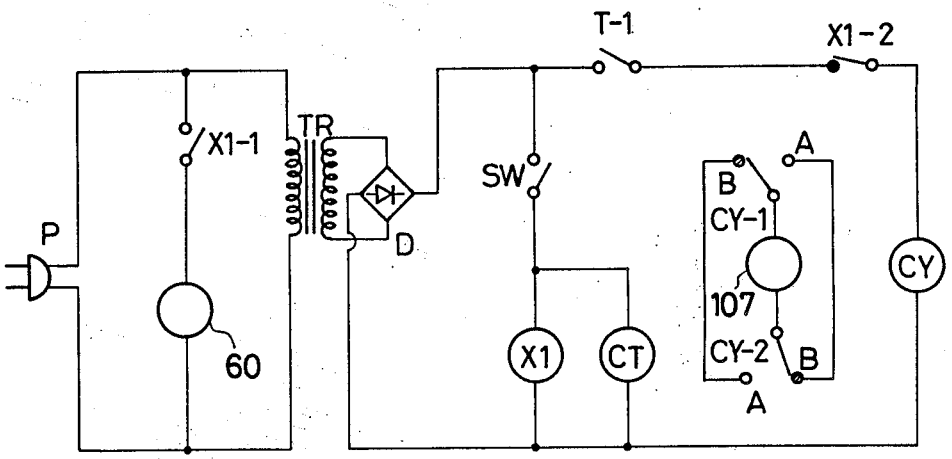
FIG. 7 is a diagram of another electric circuit which controls the garbage disposer in FIG. 1.

FIG. 7 shows an electric circuit used for control in another embodiment of the invention. In this embodiment, a primary winding of a transformer TR is connected to the plug. A secondary winding of the transformer TR is connected to a diode bridge D forming a full-wave rectifier. A wringing motor 107, which is a DC motor, is energized by the output of the diode bridge D.

When a manual switch SW is closed, a relay X1 is activated to close a contact X1-1 and to open a contact X1-2. The pulverizing motor 60 is thereby started. Also the off-delay timer CT is activated, so that the contact T-1 is closed and the wringing motor 107 is started. Then, food waste is flushed with water through the garbage discharging port 29 into the pulverizing unit 42, in which the food waste is pulverized, wrung and discharged into the garbage bag 140. Part of the pulverized garbage, particularly fibrous garbage, can be caught at the gap between an upper end 137 of the guide plate 136 and the straining drum 106.

When the switch SW is turned off, the relay X1 opens the contact X1-1 to thereby stop the pulverizing motor 60. On the other hand, the contact T-1 is kept closed for a predetermined delay time of the timer CT. In addition, as the contact X1-2 is closed, another timer CY is activated.

This timer CY periodically switches its contacts Y-1 and Y-2 between (from and to) positions A and B, thereby periodically altering the direction of the electric current supplied to the wringing motor 107, whose direction of rotation is altered as the direction of the supplied current is altered. When the contacts Y-1 and Y-2 are at the position A, the wringing motor 107 and hence the straining drum 106 rotate in the forward direction. When the contacts Y-1 and Y-2 are at the position B, the wringing motor 107 and hence the straining drum 106 rotate in the backward direction. This periodic switching is repeated several times during the off-delay time of the timer CT, so that the direction of rotation of the wringing motor 107 and hence the direction of rotation of the straining drum 106 are periodically reversed.

The time during which the wringing motor **107*a* rotates in the forward direction and the time during which the wringing motor 107*a*** rotates in backward direction need not be identical but can be different for the best result.

When the straining drum 106 is rotated in the backward direction, as indicated by the arrow in FIG. 1, the pulverized garbage caught at the gap between the guide plate 136 and the straining drum 106 is released and moved backward. When the straining drum 106 is thereafter moved forward, the pulverized garbage moves forward and some of the pulverized garbage can pass over the gap between the guide plate 136 and the straining drum 106, while the remainder can be caught again. As the back and forth rotation is repeated several times, there will be almost no pulverized garbage caught at the gap between the straining drum 106 and the guide plate 136.

Upon expiration of the off-delay time of the timer CT, the contact T-1 is opened, so the wringing motor 107 is stopped.

When a seal switch (not shown) is later closed, the sealing unit 146 is actuated to perform an automatic sealing of the opening portion of the garbage bag 140. Thereafter, the sealed garbage bag 140 may be taken out from the garbage container 144.

In this embodiment, the repeated changes of the rotation direction of the wringing motor 107 remove garbage between the straining drum 106 and the guide plate 136, thereby keeping the inside of the wringing casing 86 clean.

In the embodiment illustrated the circular cutting edges 76 of the stationary blade 73 are in the shape of a circle, but they may alternatively be in the shape of an ellipse or a rectangle.

The wringing roller unit 131 may be provided with a compression spring for depressing the wringing roller 132 against the drum body 108 to improve wringing of the wringing roller 132.

Figure 8:
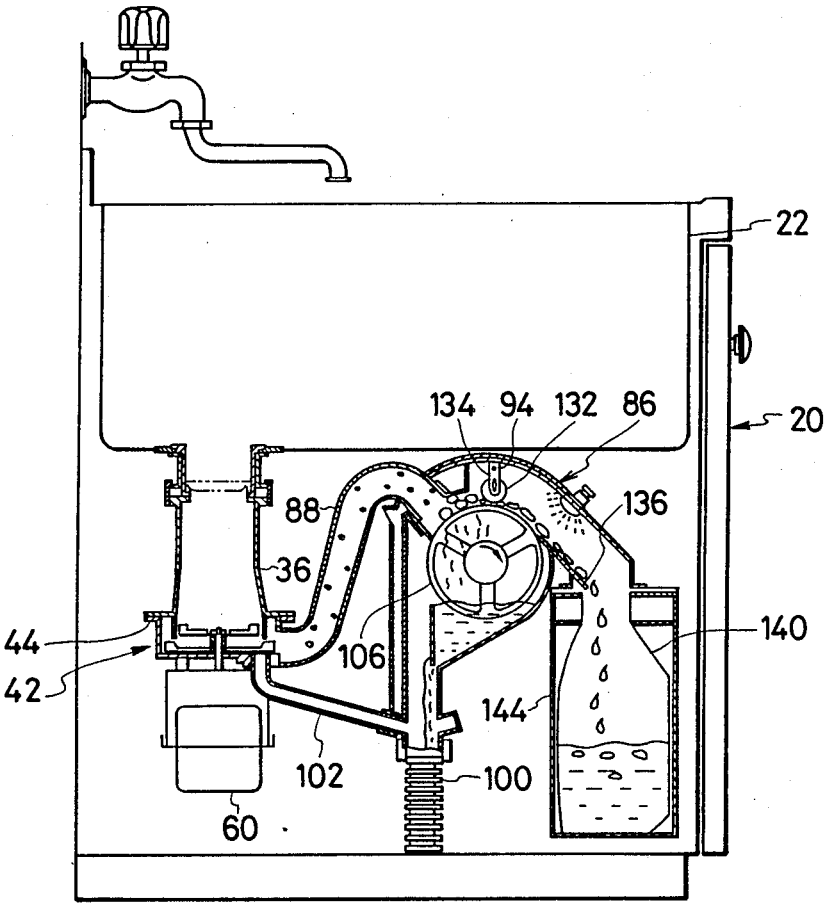
FIG. 8 is a vertical sectional view of a garbage disposer in which a modified form of the wringing roller unit of FIG. 1 is used.
Figure 9:
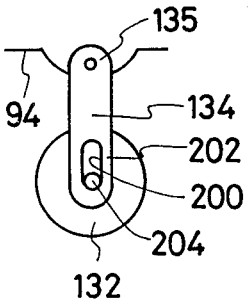
FIG. 9 is an enlarged view of the wringing roller unit in FIG. 8.

A modified form of the wringing roller unit 131 in FIG. 1 is illustrated in FIG. 8 and FIG. 9, in which a wringing roller 132 is rotatably and longitudinally movably supported on a pair of swing arms 134. More specifically, each swing arm 134 has a longitudinal slot 200 formed through a free end portion 202 thereof. The wringing roller 132 has a pair of rotating shafts 204 rotatably and longitudinally slidably fitted into respective longitudinal slots 200. In this modification the proximal ends 135 of the swing arms 134 are pivotably attached to the upper portion 94 of the casing 86 so that the swing arms 134 suspend therefrom. With such a modified structure, the wringing roller 132 is movable along the longitudinal slots 200 as well as pivotable about the proximal ends 135 of the swing arms 134 and hence smoothly follows the pulverized garbage transported on the straining drum 106. Thus, the modified wringing unit ensures steady transportation and wringing of the pulverized garbage.

Figure 10:
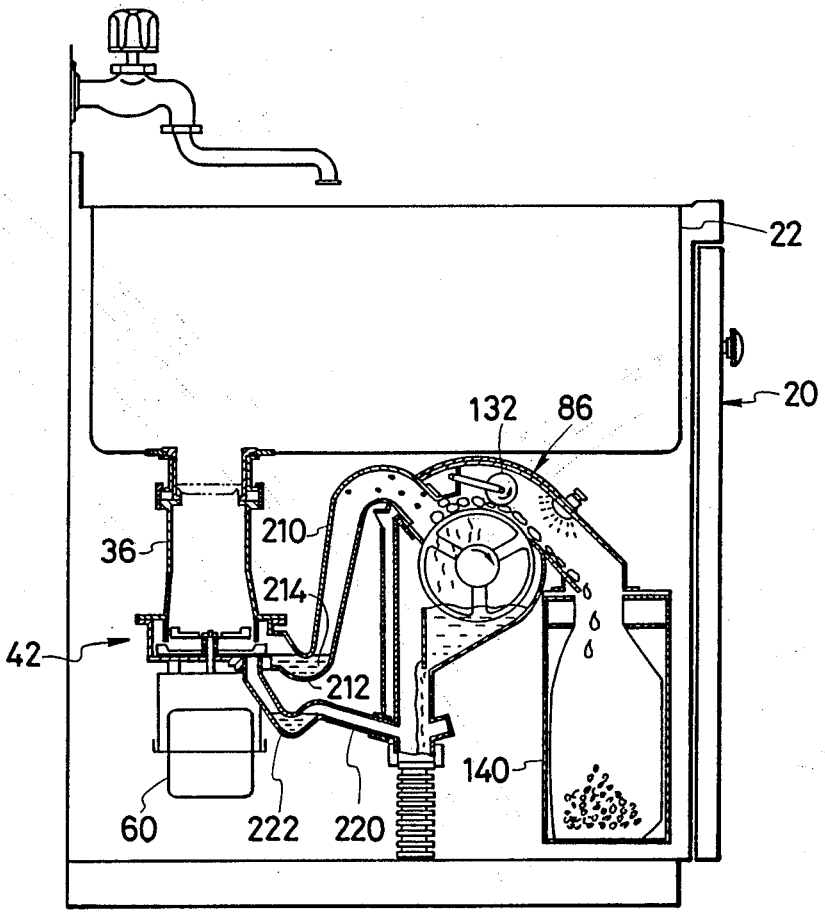
FIG. 10 is a vertical sectional view of a garbage disposer in which a modified form of each of the transporting pipe and the bypass pipe in FIG. 1 is used.

A modified form of each of the connecting pipe 88 and the bypass drain pipe 102 is shown in FIG. 10, in which the modified connecting pipe 210 is distinct from the connecting pipe 88 in that it is provided at one end close to the pulverized garbage discharge opening 50 with a water trap 214 for a water-seal. The modified bypass pipe 220 is also provided with a water trap 222 for water-seal. When a large diameter pipe is used for the bypass drain pipe 102 to rapidly discharge water in the casing 44, a bad smell may escape from the drain tube 100 into the kitchen. In this modified bypass pipe 220, the water trap 222 prevents passage of such a smell and hence ensures that the bypass pipe 220 has a sufficient diameter to rapidly drain water. The water trap 214 of the connecting pipe 210 also prevents passage of a bad smell from the wringing casing 86.

What is claimed is:

1. A garbage disposer comprising:

(a) pulverizing means, adapted to communicate to a basin of a sink through a drain hole of the basin for pulverizing the garbage charged through the drain hole thereinto together with water;

(b) straining means, connected to the pulverizing means, the straining means including a straining casing, a straining drum supported within the straining casing for rotation about a horizontal axis and a motor for rotating the straining drum, the straining drum having a circumferential face with a multiplicity of perforations formed therethrough for straining out the garbage pulverized in the pulverizing means;

(c) transporting means for transporting the garbage pulverized in the pulverizing means together with the water onto the circumferential face of the straining drum; and (d) discharging means, connected to the straining means, for discharging the strained, pulverized garbage from the straining means.

2. A garbage disposer as recited in claim 1, wherein the pulverizing means comprises: a pulverizing casing; a rotary pulverizing member supported within the pulverizing casing for rotation about a vertical axis; a stationary pulverizing member cooperative with the rotary pulverizing member to pulverize the garbage; and a pulverizing motor for rotating the rotary pulverizing member and further comprising a motor control electric circuit for controlling the motors so that the motor of the straining drum runs for a predetermined time period to substantially discharge the strained, pulverized garbage from the straining drum after the pulverizing motor stops.

3. A garbage disposer as recited in claim 2, wherein said motor control electric circuit causes said straining drum to move back and forth after said pulverizing motor stops.

4. A garbage disposer as recited in claim 2, wherein the straining means comprises a wringing roller and a pair of swing arms, each swing arm having one end, pivotably connected to the straining casing, and the other end rotatably supporting the wringing roller so that the wringing roller depresses the circumferential face of the straining drum.

5. A garbage disposer as recited in claim 4, wherein each swing arm includes a free end portion having a guide slot longitudinally formed therethrough, and wherein the wringing roller includes a pair of rotation shafts concentrically mounted on opposite ends thereof, the rotation shafts slidably fitted into respective guide slots.

6. A garbage disposer as recited in claim 4, wherein the transporting means includes: a vane member rotatably supported within the pulverizing casing to be positioned coaxially with and below the rotary pulverizing member, the vane member being adapted to be rotated by the pulverizing motor, and a transporting pipe communicating the pulverizing casing with the straining casing for transporting the pulverized garbage to the circumferential face of the straining drum by pressure produced by the vane member, wherein the horizontal axis of the straining drum is located above the vane member.

7. A garbage disposer as recited in claim 6, wherein the pulverizing casing includes a circumferential side wall and a bottom wall on which the circumferential side wall is erected; the stationary pulverizing member includes a hollow cylindrical stationary blade mounted to the pulverizing casing to externally surround the rotary pulverizing member concentrically with respect to the circumferential side wall, the stationary blade and the side wall surrounding an annular pulverized garbage chamber therebetween; the pulverizing casing having a vertical axis; the pulverizing means including a vertical rotary shaft concentrically supported on the pulverizing casing for rotation about the vertical axis, the rotary shaft being operatively connected to the pulverizing motor, the rotary pulverizing member and the vane member being mounted to the rotary shaft; the vane member having an outer end and including a vane mounted at the outer end, the vane being located just below the annular pulverized garbage chamber; the transporting pipe communicating with the pulverizing casing at the side wall of the pulverizing casing close to the vane member; and further comprising a bypass pipe, communicating at one end of to the pulverizing casing at the bottom wall thereof and adapted to connect at the other end to a drain pipe for draining water in the pulverizing casing, the straining casing being adapted to communicate with the drain pipe for draining water therefrom.

8. A garbage disposer as recited in claim 7, wherein the transporting pipe includes a water trap for preventing passage of a bad smell from the straining casing and wherein the bypass pipe includes a water trap for preventing passage of a bad smell from the drain pipe.

9. A garbage disposer as recited in claim 8, wherein the straining casing comprises a sump mounted below the straining drum, for containing water strained off from the pulverized garbage through the straining perforations of the straining drum, the straining drum being arranged to be washed with water in the sump.

* * * * *